US011366416B2

(12) United States Patent
Arai et al.

(10) Patent No.: US 11,366,416 B2
(45) Date of Patent: Jun. 21, 2022

(54) LIGHT-EMITTING-DEVICE HEAD AND IMAGE FORMING APPARATUS WITH SWITCHING UNIT DEFINING SWITCHING POSITIONS COINCIDING WITH DOTS IN AN IMAGE

(71) Applicant: FUJIFILM Business Innovation Corp., Tokyo (JP)

(72) Inventors: Shigeru Arai, Kanagawa (JP); Kyoji Yagi, Kanagawa (JP); Shun Yashima, Kanagawa (JP); Junichiro Mori, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/141,767

(22) Filed: Jan. 5, 2021

(65) Prior Publication Data

US 2022/0091549 A1 Mar. 24, 2022

(30) Foreign Application Priority Data

Sep. 24, 2020 (JP) ..... JP2020-159616

(51) Int. Cl.
*G03G 15/04* (2006.01)
*G03G 15/34* (2006.01)

(52) U.S. Cl.
CPC ..... *G03G 15/344* (2013.01); *G03G 15/04054* (2013.01)

(58) Field of Classification Search
USPC ..... 399/177
See application file for complete search history.

(56) References Cited

U.S. PATENT DOCUMENTS 9,983,500 B2 * 5/2018 Yano ..... G03G 15/04054
2016/0274481 A1 * 9/2016 Kawanabe ..... G03G 21/08
2017/0289385 A1 * 10/2017 Wada ..... G03G 15/04036

FOREIGN PATENT DOCUMENTS

JP 2009-226712 A 10/2009

* cited by examiner

*Primary Examiner* — Quana Grainger
(74) *Attorney, Agent, or Firm* — Sughrue Mion, PLLC

(57) ABSTRACT

A light-emitting-device head includes a first light-emitting-device arrangement including light emitting devices arranged in lines extending in a first scanning direction; a second light-emitting-device arrangement including light emitting devices arranged in lines extending in a first scanning direction, the second light-emitting-device arrangement overlapping the first light-emitting-device arrangement in a second scanning direction at least in part; an optical device that forms an electrostatic latent image by focusing light emitted from the light emitting devices on a photoconductor and exposing the photoconductor to the light; and a switching unit that switches the light-emitting-device arrangement to be lit up between the first light-emitting-device arrangement and the second light-emitting-device arrangement at a switching position defined at any position in an overlapping portion where the first light-emitting-device arrangement and the second light-emitting-device arrangement overlap each other. The electrostatic latent image is composed of dots formed by a screening process performed with a screen having a predetermined screen angle. The switching unit defines the switching position such that when points in the electrostatic latent image that coincide with the switching position are connected to one another by a line, the line forms a zigzag shape while overlapping some of the dots, the zigzag shape including a line segment extending at the screen angle.

9 Claims, 13 Drawing Sheets

LIGHT-EMITTING-DEVICE HEAD AND IMAGE FORMING APPARATUS WITH SWITCHING UNIT DEFINING SWITCHING POSITIONS COINCIDING WITH DOTS IN AN IMAGE

CROSS-REFERENCE TO RELATED APPLICATIONS

This application is based on and claims priority under 35 USC 119 from Japanese Patent Application No. 2020-159616 filed Sep. 24, 2020.

BACKGROUND

(i) Technical Field

The present disclosure relates to a light-emitting-device head and an image forming apparatus.

(ii) Related Art

An electrophotographic image forming apparatus, such as a printer; a multifunction machine; or a facsimile, forms an image by applying light representing image information from an optical recording unit to a charged photoconductor to form an electrostatic latent image, visualizing the electrostatic latent image with toner, transferring the visualized image to a recording medium, and fixing the image. Examples of the optical recording unit include a unit employing an optical scanning scheme in which the unit performs exposure by moving laser light of a laser in a first scanning direction. A recent optical recording unit employs a light-emitting-device head in which a number of light emitting devices such as light emitting diodes (LEDs) are arranged in the first scanning direction.

An image forming apparatus disclosed by Japanese Unexamined Patent Application Publication No. 2009-226712 includes LED print heads (LPHs) as light-emitting-device arrangements that are staggered such that exposure areas of adjacent ones of the LPHs overlap in part, whereby dot cores in a dot halftone image obtained through dot halftoning performed by an image processing unit are formed by light emitting devices that are adjacent to each other at the boundary between different light-emitting-device arrangements.

SUMMARY

It is difficult to manufacture a light-emitting-device head in which light emitting devices that are arranged in the first scanning direction are all provided on a single substrate. Therefore, in some cases, a plurality of substrates are arranged in a staggered manner in the first scanning direction while overlapping one another in part in a second scanning direction, and the substrate to be used for light emission is switched at each of the overlapping portions. In such a case, however, the image formed on the recording medium may have a black line or a white line at each of switching positions where the above switching occurs.

Aspects of non-limiting embodiments of the present disclosure relate to a light-emitting-device head and so forth in which an image formed on a recording medium is less likely to have a black line or a white line at each switching position than in a case where the switching position is not varied with the positions of dots.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a light-emitting-device head including a first light-emitting-device arrangement including light emitting devices arranged in lines extending in a first scanning direction; a second light-emitting-device arrangement including light emitting devices arranged in lines extending in a first scanning direction, the second light-emitting-device arrangement overlapping the first light-emitting-device arrangement in a second scanning direction at least in part; an optical device that forms an electrostatic latent image by focusing light emitted from the light emitting devices on a photoconductor and exposing the photoconductor to the light; and a switching unit that switches the light-emitting-device arrangement to be lit up between the first light-emitting-device arrangement and the second light-emitting-device arrangement at a switching position defined at any position in an overlapping portion where the first light-emitting-device arrangement and the second light-emitting-device arrangement overlap each other. The electrostatic latent image is composed of dots formed by a screening process performed with a screen having a predetermined screen angle. The switching unit defines the switching position such that when points in the electrostatic latent image that coincide with the switching position are connected to one another by a line, the line forms a zigzag shape while overlapping some of the dots, the zigzag shape including a line segment extending at the screen angle.

BRIEF DESCRIPTION OF THE DRAWINGS

An exemplary embodiment of the present disclosure will be described in detail based on the following figures, wherein.

DETAILED DESCRIPTION

Description of Overall Configuration of Image Forming Apparatus

Figure 1:
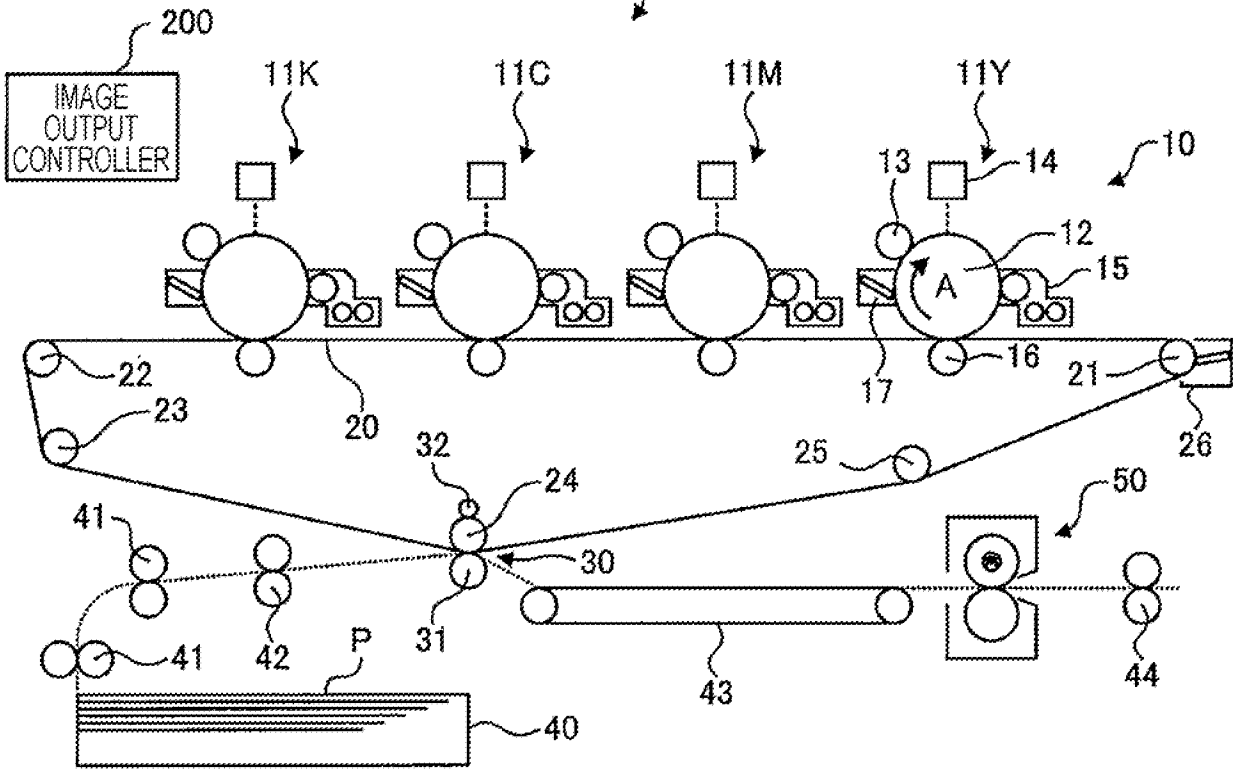
FIG. 1 illustrates an outline of an image forming apparatus according to an exemplary embodiment.

FIG. 1 illustrates an outline of an image forming apparatus 1 according to an exemplary embodiment.

The image forming apparatus 1 is a so-called tandem image forming apparatus. The image forming apparatus 1 includes an image forming section 10 that forms an image in correspondence with pieces of image data for different colors. The image forming apparatus 1 further includes an intermediate transfer belt 20 that carries toner images formed with different color components by respective image forming units 11 and sequentially transferred thereto (first transfer). The image forming apparatus 1 further includes a second transfer device 30 that collectively transfers the toner images from the intermediate transfer belt 20 to a sheet P (second transfer). The sheet P is an exemplary recording medium. The image forming apparatus 1 further includes a fixing device 50 that fixes the second-transferred toner images on the sheet P, thereby finishing the image. The fixing device 50 is an exemplary fixing unit. The image forming apparatus 1 further includes an image output controller 200 that controls relevant mechanical elements of the image forming apparatus 1 and executes a predetermined imaging process on the image data.

The image forming section 10 includes, for example, a plurality (four in the present exemplary embodiment) of image forming units 11 (specifically, 11Y (yellow), 11M (magenta), 11C (cyan), and 11K (black)) that electrophotographically form toner images with respective color components. The image forming units 11 are each an exemplary toner-image-forming unit that forms a toner image.

The image forming units 11 (11Y, 11M, 11C, and 11K) all have the same configuration except the colors of toner to be used. Therefore, the yellow image forming unit 11Y is taken as an example in the following description. The yellow image forming unit 11Y includes a photoconductor drum 12 having a photosensitive layer (not illustrated) and rotatable in a direction of arrow A. The photoconductor drum 12 is surrounded by a charging roller 13, a light-emitting-device head 14, a developing device 15, a first transfer roller 16, and a drum cleaner 17. The charging roller 13 is rotatably in contact with the photoconductor drum 12 and charges the photoconductor drum 12 to a predetermined potential. The light-emitting-device head 14 applies light to the photoconductor drum 12 charged to the predetermined potential by the charging roller 13 and forms an electrostatic latent image thereon. The developing device 15 contains toner of a corresponding one of the color components (yellow toner for the yellow image forming unit 11Y). The toner is used for developing the electrostatic latent image on the photoconductor drum 12. The first transfer roller 16 first-transfers the toner image from the photoconductor drum 12 to the intermediate transfer belt 20. The drum cleaner 17 removes residual matter (toner and so forth) from the photoconductor drum 12 having undergone first transfer.

The photoconductor drum 12 serves as an image carrying member that carries an image. The charging roller 13 serves as a charging unit that charges the surface of the photoconductor drum 12. The light-emitting-device head 14 serves as an electrostatic-latent-image-forming unit (a lighting device) that exposes the photoconductor drum 12 to light and thus forms an electrostatic latent image on the photoconductor drum 12. The developing device 15 serves as a developing unit that develops the electrostatic latent image into a toner image.

The intermediate transfer belt 20 as an image transfer member is stretched around and rotatably supported by a plurality (five in the present exemplary embodiment) of supporting rollers. The supporting rollers include a driving roller 21 that stretches the intermediate transfer belt 20 and drives the intermediate transfer belt 20 to rotate. The supporting rollers further include stretching rollers 22 and 25 that stretch the intermediate transfer belt 20 and rotate by following the intermediate transfer belt 20 driven by the driving roller 21. A correction roller 23 stretches the intermediate transfer belt 20 and serves as a steering roller (tiltable on one axial end thereof) that suppresses the meandering of the intermediate transfer belt 20 in a direction substantially orthogonal to the direction of transport. A backup roller 24 stretches the intermediate transfer belt 20 and serves as a member included in the second transfer device 30 to be described below.

A belt cleaner 26 that removes residual matter (toner and so forth) from the intermediate transfer belt 20 having undergone second transfer is provided across the intermediate transfer belt 20 from the driving roller 21.

Although details are to be described below, the image forming unit 11 according to the present exemplary embodiment forms a density-correction image (a reference patch or a density-correction toner image) having a predetermined density intended for correction of image density. The density-correction image is an exemplary image for adjusting the state of the apparatus.

The second transfer device 30 includes a second transfer roller 31 pressed against a side of the intermediate transfer belt 20 on which the toner images are to be carried, and the backup roller 24 positioned on the other side of the intermediate transfer belt 20 and serving as a counter electrode to the second transfer roller 31. A power feeding roller 32 that applies a second transfer bias to the backup roller 24 is provided in contact with the backup roller 24. The second transfer bias has the polarity with which the toner is charged. The second transfer roller 31 is grounded.

In the image forming apparatus 1 according to the present exemplary embodiment, a set of the intermediate transfer belt 20, the first transfer rollers 16, and the second transfer roller 31 serves as a transfer unit that transfers the toner images to the sheet P.

A sheet transporting system includes a sheet tray 40, transporting rollers 41, a registration roller 42, a transporting belt 43, and a discharge roller 44. In the sheet transporting system, the transporting rollers 41 transport one of the sheets P stacked on the sheet tray 40. Then, the registration roller 42 temporarily stops the sheet P, and transports the sheet P to a second transfer position in the second transfer device 30 at a predetermined timing. Subsequently, the transporting belt 43 transports the sheet P having undergone second transfer to the fixing device 50. Then, the discharge roller 44 receives the sheet P from the fixing device 50 and discharges the sheet P to the outside.

Now, a basic imaging process performed by the image forming apparatus 1 will be described. When a start switch (not illustrated) is turned on, a predetermined imaging process is executed. Specifically, if the image forming apparatus 1 is configured as a printer for example, the image output controller 200 first receives image data inputted from an external apparatus such as a personal computer (PC). The image data thus received is subjected to an imaging process performed by the image output controller 200 and is supplied to the image forming units 11. Then, the image forming units 11 form toner images in the respective colors. Specifically, the image forming units 11 (specifically, 11Y, 11M, 11C, and 11K) are activated in accordance with digital image signals for the respective colors. In each of the image forming units 11, light representing the digital image signal is applied from the light-emitting-device head (LPH) 14 to the photoconductor drum 12 charged by the charging roller 13, whereby an electrostatic latent image is formed. Then, the electrostatic latent image formed on the photoconductor drum 12 is developed by the developing device 15 into a toner image in a corresponding one of the colors. If the image forming apparatus 1 is configured as a multifunction machine, a document that is set on a document table (not illustrated) is read by a scanner, a signal obtained by the reading is converted into a digital image signal by a processing circuit, and toner images in the respective colors are formed as described above.

Subsequently, the toner images formed on the respective photoconductor drums 12 are sequentially first-transferred to the surface of the intermediate transfer belt 20 by the respective first transfer rollers 16 at respective first transfer positions where the respective photoconductor drums 12 are in contact with the intermediate transfer belt 20. Meanwhile, residual toner on the photoconductor drums 12 having undergone first transfer is removed by the respective drum cleaners 17.

Thus, the toner images first-transferred to the intermediate transfer belt 20 are superposed one on top of another on the intermediate transfer belt 20 and are transported to the second transfer position with the rotation of the intermediate transfer belt 20. Meanwhile, a sheet P is transported to the second transfer position at a predetermined timing and is nipped between the backup roller 24 and the second transfer roller 31 pressed toward the backup roller 24.

At the second transfer position, the toner images carried by the intermediate transfer belt 20 are second-transferred to the sheet P by the effect of a transfer electric field generated between the second transfer roller 31 and the backup roller 24. The sheet P now having the toner images is transported to the fixing device 50 by the transporting belt 43. The fixing device 50 fixes the toner images on the sheet P by applying heat and pressure to the toner images. Then, the sheet P is transported to the sheet output tray (not illustrated) provided outside the apparatus. Meanwhile, residual toner on the intermediate transfer belt 20 having undergone second transfer is removed by the belt cleaner 26.

Description of Light-Emitting-Device Head 14

Figure 2:
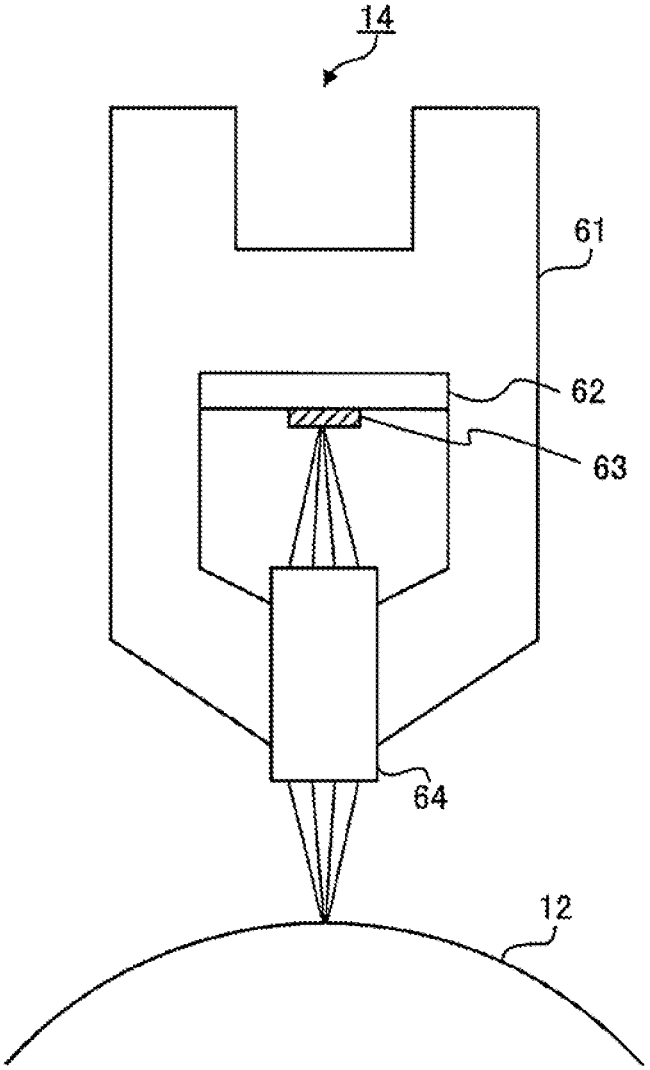
FIG. 2 illustrates a configuration of a light-emitting-device head to which the exemplary embodiment is applied.

FIG. 2 illustrates a configuration of the light-emitting-device head 14 to which the exemplary embodiment is applied.

The light-emitting-device head 14 includes a housing 61, a light emitting unit 63 including a plurality of LEDs as light emitting devices, a circuit board 62 carrying elements such as the light emitting unit 63 and a signal generating circuit 100 (see FIG. 5 to be referred to below), and a rod lens (radial-gradient-index lens) array 64 as an exemplary optical device that forms an electrostatic latent image by focusing the light emitted from the LEDs on the photoconductor drum 12 and exposing the photoconductor drum 12 to the light.

The housing 61 is made of metal, for example. The housing 61 supports the circuit board 62 and the rod lens array 64 such that the point of light emission from the light emitting unit 63 coincides with the focal plane of the rod lens array 64. The rod lens array 64 extends in the axial direction (a first scanning direction) of the photoconductor drum 12.

Description of Light Emitting Unit 63

Figure 3A:
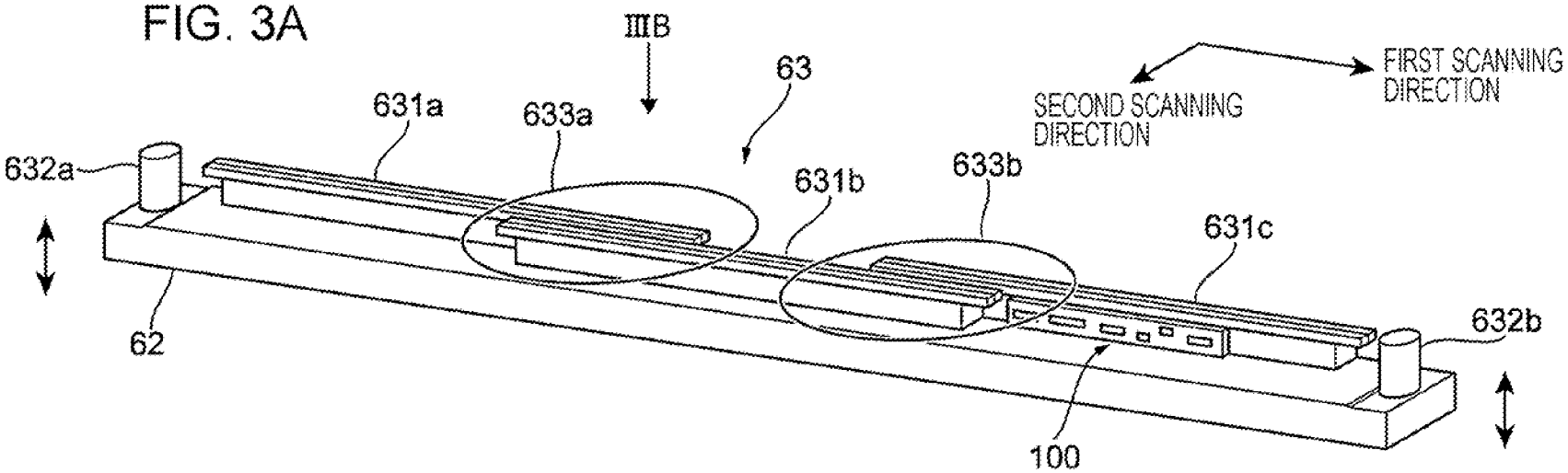
FIG. 3A is a perspective view of a circuit board and a light emitting unit included in the light-emitting-device head.

FIG. 3A is a perspective view of the circuit board 62 and the light emitting unit 63 included in the light-emitting-device head 14.

As illustrated in FIG. 3A, the light emitting unit 63 includes LPH bars 631*a* to 631*c*, focus adjusting pins 632*a* and 632*b*, and the signal generating circuit 100 as an exemplary controller that controls the light emission from the LEDs.

The LPH bars 631*a* to 631*c* are arranged on the circuit board 62 in a staggered manner in the first scanning direction. Each two of the LPH bars 631*a* to 631*c* that are adjacent in the first scanning direction overlap each other in part in a second scanning direction. The overlaps are denoted as double portions 633*a* and 633*b*. In the above case, the double portion 633*a* is the overlap between the LPH bar 631*a* and the LPH bar 631*b* in the second scanning direction. The double portion 633*b* is the overlap between the LPH bar 631*b* and the LPH bar 631*c* in the second scanning direction.

Hereinafter, the LPH bars 631*a* to 631*c* may be simply referred to as LPH bars 631 if they are not distinguished from one another. Likewise, the focus adjusting pins 632*a* and 632*b* may be hereinafter simply referred to as focus adjusting pins 632 if they are not distinguished from each other. Furthermore, the double portions 633*a* and 633*b* may be hereinafter simply referred to as double portions 633 if they are not distinguished from each other.

Figure 3B:
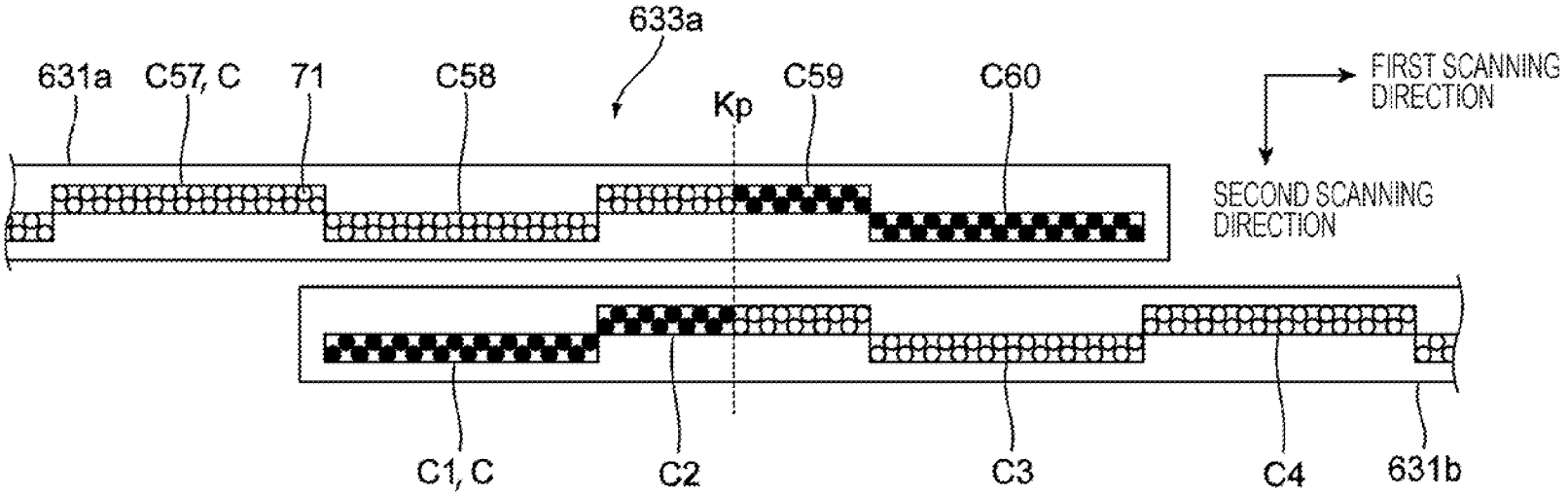
FIG. 3B is an enlargement of a part of the light emitting unit seen in a direction of arrow IIIB illustrated in FIG. 3A.

FIG. 3B is an enlargement of a part of the light emitting unit 63 seen in a direction of arrow IIIB illustrated in FIG. 3A. FIG. 3B illustrates the double portion 633*a* between the LPH bar 631*a* and the LPH bar 631*b*.

As illustrated in FIG. 3B, the LPH bar 631*a* and the LPH bar 631*b* each include light emitting chips C as exemplary light-emitting-device-array chips. The light emitting chips C are arranged in two rows extending in the first scanning direction and staggered with respect to each other. The LPH bar 631*a* and the LPH bar 631*b* each include, for example, sixty light emitting chips C. Hereinafter, the sixty light emitting chips C may be individually denoted as light emitting chips C1 to C60. As illustrated in FIG. 3B, the light emitting chips C each include LEDs 71. Specifically, in the present exemplary embodiment, a predetermined number of LEDs 71 are mounted on each of the light emitting chips C and are arranged in lines extending in the first scanning direction. The LEDs 71 are lit up in units of one light emitting chip C sequentially in the first scanning direction or in a direction opposite to the first scanning direction.

The LPH bar 631*c* (not illustrated in FIG. 3B) has the same configuration as the LPH bar 631*a* and the LPH bar 631*b*. The double portion 633*b* has the same configuration as the double portion 633*a*.

In the above configuration, the group of LEDs 71 mounted on each of the LPH bar 631*a* and the LPH bar 631*c* is regarded as a first light-emitting-device arrangement including a plurality of LEDs 71 arranged in lines extending in the first scanning direction. The group of LEDs 71 mounted on the LPH bar 631*b* overlaps each of the first light-emitting-device arrangements in the second scanning direction at least in part and is regarded as a second light-emitting-device arrangement including a plurality of LEDs 71 arranged in lines extending in the first scanning direction.

The double portions 633*a* and 633*b* are each regarded as an exemplary overlapping portion where the first light-emitting-device arrangement and the second light-emitting-device arrangement overlap each other.

The first light-emitting-device arrangement and the second light-emitting-device arrangement may each be described as a structure obtained by arranging the light emitting chips C each including the LEDs 71 arranged in lines extending in the first scanning direction.

The light-emitting-device arrangement to be lit up is switched between the first light-emitting-device arrangement and the second light-emitting-device arrangement at a switching position Kp defined at any position in each of the double portions 633*a* and 633*b*. In short, the LPH bar 631 to be lit up is changed at the switching position Kp. In this case, the LPH bar 631 carrying the LEDs 71 to be lit up is switched in order of the LPH bar 631*a*, the LPH bar 631*b*, and the LPH bar 631*c*.

In FIG. 3B, the LEDs 71 illustrated as white dots are lit up, whereas the LEDs 71 illustrated as black dots are not lit up. That is, FIG. 3B illustrates a case where the LEDs 71 to be lit up are switched at the switching position Kp from those on the LPH bar 631*a* to those on the LPH bar 631*b*. On the left side with respect to the switching position Kp in FIG. 3B, the LEDs 71 on the LPH bar 631*a* are lit up. On the right side with respect to the switching position Kp in FIG. 3B, the LEDs 71 on the LPH bar 631*b* are lit up.

The switching position Kp is arbitrarily settable within each of the double portions 633*a* and 633*b*. The operation of controlling the switching is undergone by the signal generating circuit 100. Therefore, the signal generating circuit 100 serves as a switching unit that switches the light-emitting-device arrangement to be lit up between the first light-emitting-device arrangement and the second light-emitting-device arrangement at the switching position Kp.

The focus adjusting pins 632*a* and 632*b* allow the circuit board 62 to move in the up-and-down direction as indicated by double-headed arrow illustrated in FIG. 3A. In short, the circuit board 62 is movable up and down. The distance between the light emitting unit 63 and the photoconductor drum 12 is changeable by moving the circuit board 62 up and down. Hence, the distance between the photoconductor drum 12 and the LPH bars 631*a* to 631*c* is changeable to adjust the focus of the light emitted from the LEDs 71 to the photoconductor drum 12. With the focus adjusting pins 632*a* and 632*b*, both a side of the circuit board 62 that is nearer to the focus adjusting pin 632*a* and a side of the circuit board 62 that is nearer to the focus adjusting pin 632*b* may be moved upward. Furthermore, both the side of the circuit board 62 that is nearer to the focus adjusting pin 632*a* and the side of the circuit board 62 that is nearer to the focus adjusting pin 632*b* may be moved downward. Furthermore, while one of the side of the circuit board 62 that is nearer to the focus adjusting pin 632*a* and the side of the circuit board 62 that is nearer to the focus adjusting pin 632*b* is moved upward, the other may be moved downward. The focus adjusting pins 632*a* and 632*b* may be controlled by the signal generating circuit 100 or by manual operation.

Description of Light-Emitting-Device-Array Chip

Figure 4A:
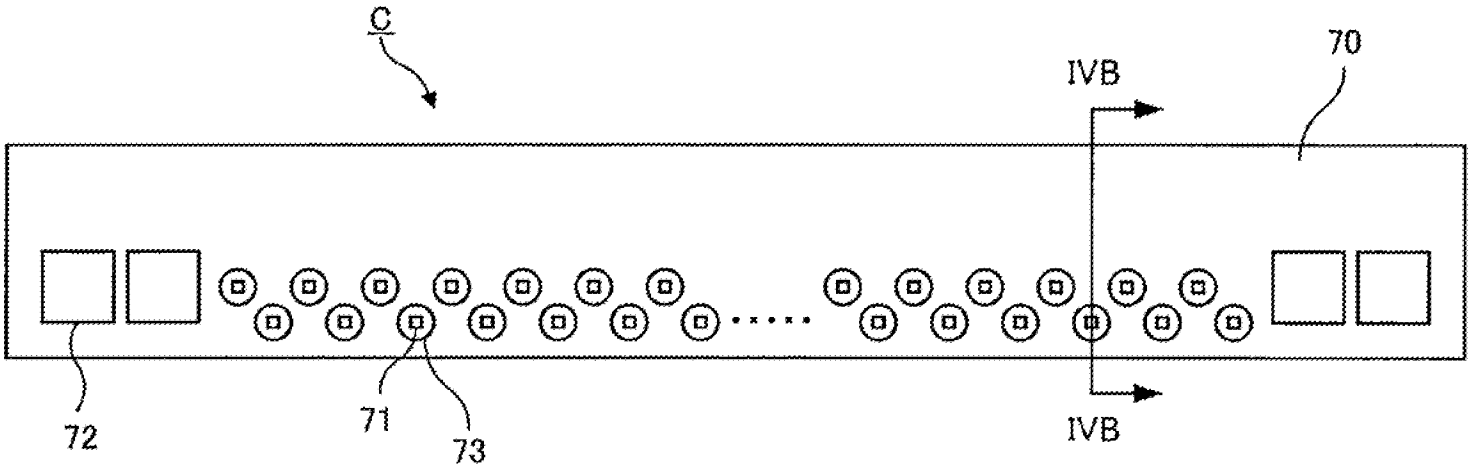
FIGS. 4A and 4B illustrate a configuration of a light emitting chip to which the exemplary embodiment is applied.
Figure 4B:
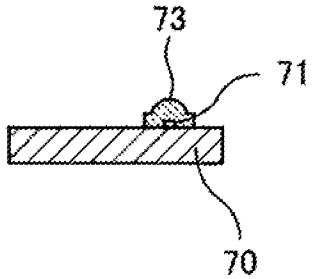

FIGS. 4A and 4B illustrate a configuration of the light emitting chip C to which the exemplary embodiment is applied.

FIG. 4A illustrates the light emitting chip C seen from a side toward which the LEDs 71 emit light. FIG. 4B is a sectional view taken along line IVB-IVB illustrated in FIG. 4A.

The light emitting chip C includes a plurality of LEDs 71 arranged in lines and at regular intervals in the first scanning direction, thereby forming an exemplary light-emitting-device array. The light emitting chip C further includes bonding pads 72 provided at both ends of a substrate 70, with the light-emitting-device array positioned in between. The bonding pads 72 each serve as an exemplary electrode provided for inputting and outputting signals for driving the light-emitting-device array. Each of the LEDs 71 has a microlens 73 on a side thereof toward which light is emitted. The light emitted from the LEDs 71 is condensed by the microlenses 73 and is efficiently applied to the photoconductor drum 12 (see FIG. 2).

The microlens 73 is made of transparent resin such as photocurable resin and may have an aspherical surface for highly efficient condensation of light. The size, thickness, focal length, and other relevant factors of the microlenses 73 are determined by the wavelength of the LEDs 71 to be used, the refractive index of the photocurable resin to be used, and the like.

Description of Self-Scanning Light-Emitting-Device-Array Chip

In the present exemplary embodiment, a self-scanning light-emitting-device (SLED)-array chip may be employed as the light-emitting-device-array chip exemplified as the light emitting chip C. The self-scanning light-emitting-device-array chip as the light-emitting-device-array chip employs light emitting thyristors each having a pnpn structure, so that a self-scanning operation of the light emitting devices is realized.

Figure 5:
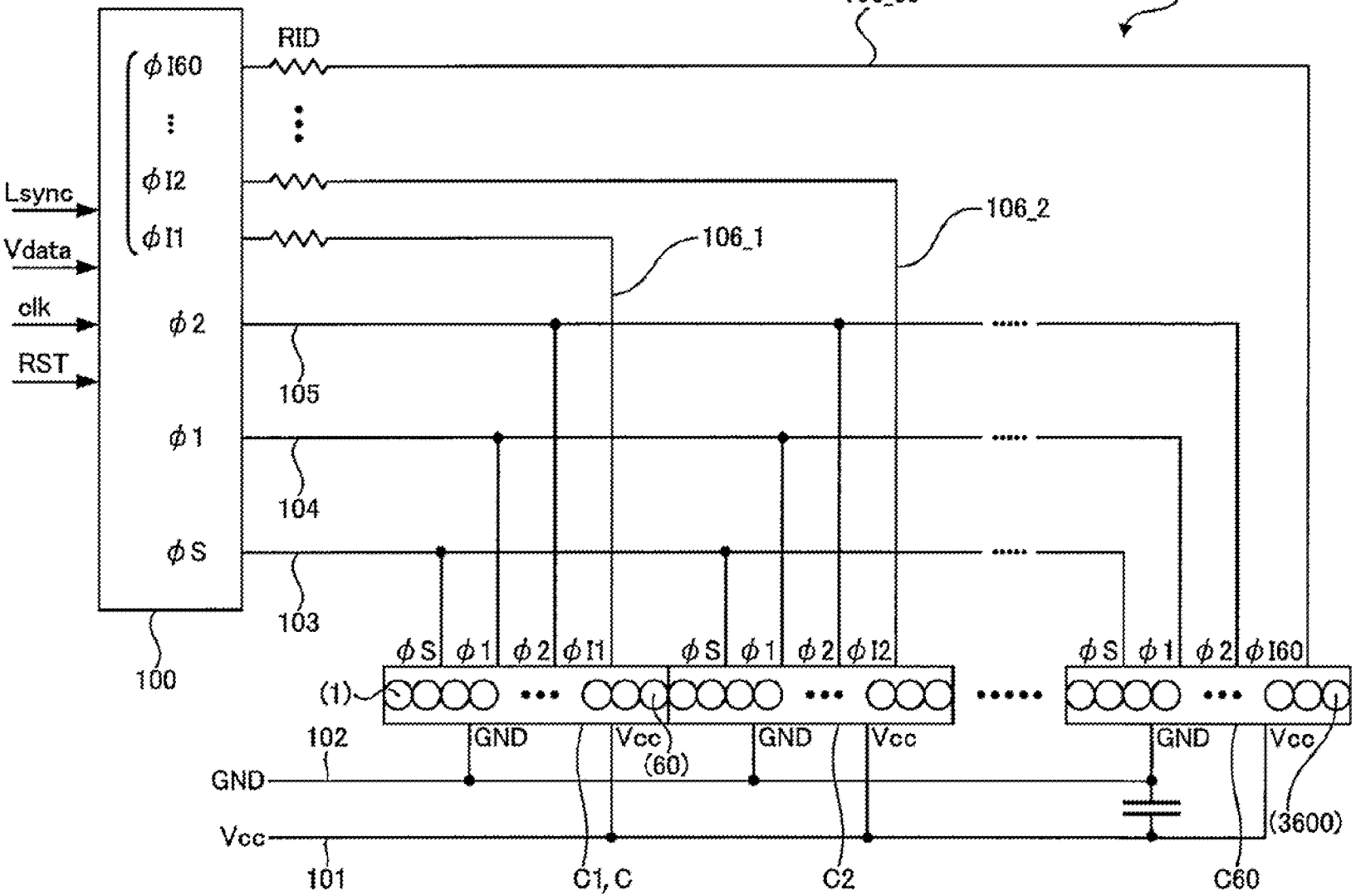
FIG. 5 illustrates a configuration of a signal generating circuit and a wiring scheme of the circuit board in a case where self-scanning light-emitting-device-array chips are employed as the light emitting chips.

FIG. 5 illustrates a configuration of the signal generating circuit 100 and a wiring scheme of the circuit board 62 in a case where self-scanning light-emitting-device-array chips are employed as the light emitting chips C.

The signal generating circuit 100 receives various control signals, such as a line synchronization signal Lsync; image data Vdata; a clock signal clk; and a reset signal RST, from the image output controller 200 (see FIG. 1). In accordance with the control signals inputted from the external apparatus, the signal generating circuit 100 undergoes relevant operations such as adjustment of the order of pieces of image data Vdata and correction of output values, and outputs light emission signals φI (φI1 to φI60) to the light emitting chips C (C1 to C60), respectively. In the present exemplary embodiment, each of the light emitting chips C (C1 to C60) is supplied with one light emission signal φI (a corresponding one of signals φI1 to φI60).

Furthermore, in accordance with the control signals inputted from the external apparatus, the signal generating circuit 100 outputs a start transfer signal φS, a first transfer signal φ1, and a second transfer signal φ2 to the light emitting chips C1 to C60.

The circuit board 62 is provided with a power supply line 101 for power supply and a power supply line 102 for grounding. The power supply line 101 is connected to Vcc terminals of the light emitting chips C1 to C60, where Vcc=−5.0 V. The power supply line 102 is connected to GND terminals. Furthermore, the circuit board 62 is provided with a start-transfer-signal line 103 that transmits the start transfer signal φS, the first transfer signal φ1, and the second transfer signal φ2 that are generated by the signal generating circuit 100; a first-transfer-signal line 104; and a second-transfer-signal line 105. Furthermore, the circuit board 62 is provided with sixty light-emission-signal lines 106 (106_1 to 106_60) through which the signal generating circuit 100 outputs the light emission signals φI (φI1 to φI60) to the light emitting chips C (C1 to C60), respectively. Note that the circuit board 62 is provided with sixty light-emission-current-limiting resistors RID for suppressing excessive flow of current to the sixty light-emission-signal lines 106 (106_1 to 106_60). As to be described separately below, the level of each of the light emission signals φI1 to φI60 is changeable between a high level (H) and a low level (L). The low level corresponds to a potential of −5.0 V. The high level corresponds to a potential of +/−0.0 V.

Figure 6:
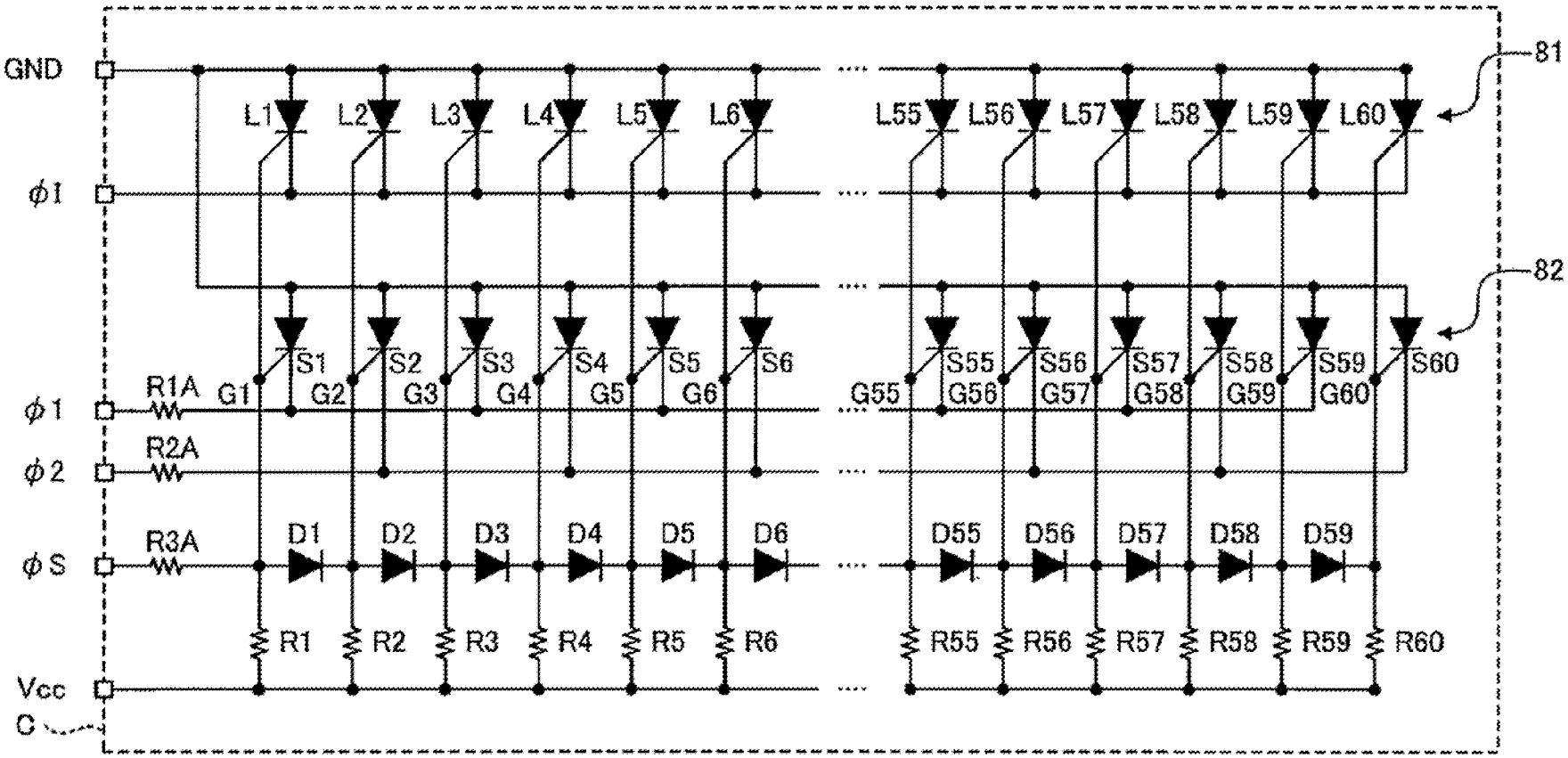
FIG. 6 illustrates a circuit configuration of the light emitting chip.

FIG. 6 illustrates a circuit configuration of each of the light emitting chips C (C1 to C60).

The light emitting chip C includes sixty transfer thyristors S1 to S60, and sixty light emission thyristors L1 to L60. The light emission thyristors L1 to L60 each have the same pnpn structure as the transfer thyristors S1 to S60 and serve as a light emitting diode (LED) when using a pn structure included therein. The light emitting chip C further includes fifty-nine diodes D1 to D59 and sixty resistors R1 to R60. The light emitting chip C further includes transfer-current-limiting resistors R1A, R2A, and R3A for suppressing excessive flow of current to the signal lines to be supplied with the first transfer signal φ1, the second transfer signal φ2, and the start transfer signal φS. The light emission thyristors L1 to L60, which form a light-emitting-device array 81, are arranged in order of L1, L2, . . . , L59, and L60 from the left side in FIG. 6, forming a light-emitting-device arrangement. The transfer thyristors S1 to S60 are also arranged in order of S1, S2, . . . , S59, and S60 from the left side in FIG. 6, forming a switching-device arrangement, i.e. a switching device array 82. The diodes D1 to D59 are also arranged in order of D1, D2, . . . , D58, and D59 from the left side in FIG. 6. The resistors R1 to R60 are also arranged in order of R1, R2, . . . , R59, and R60 from the left side in FIG. 6.

Now, an electrical connection of the devices included in the light emitting chip C will be described.

Anode terminals of the transfer thyristors S1 to S60 are connected to the GND terminal. The power supply line 102 (see FIG. 5) is connected to the GND terminal, which is thus grounded.

Cathode terminals of odd-number transfer thyristors S1, S3, . . . , and S59 are connected to a φ1 terminal through the transfer-current-limiting resistor R1A. The first-transfer-signal line 104 (see FIG. 5) is connected to the φ1 terminal, which is thus supplied with the first transfer signal φ1.

On the other hand, cathode terminals of even-number transfer thyristors S2, S4, . . . , and S60 are connected to a φ2 terminal through the transfer-current-limiting resistor R2A. The second-transfer-signal line 105 (see FIG. 5) is connected to the φ2 terminal, which is thus supplied with the second transfer signal φ2.

Gate terminals G1 to G60 of the transfer thyristors S1 to S60 are connected to the Vcc terminal through the resistors R1 to R60 provided in correspondence with the transfer thyristors S1 to S60. The power supply line 101 (see FIG. 5) is connected to the Vcc terminal, which is thus supplied with a power supply voltage Vcc (−5.0 V).

The gate terminals G1 to G60 of the transfer thyristors S1 to S60 are connected to gate terminals of the light emission thyristors L1 to L60, respectively, which are denoted by corresponding reference numerals.

Anode terminals of the diodes D1 to D59 are connected to the gate terminals G1 to G59 of the transfer thyristors S1 to S59. Cathode terminals of the diodes D1 to D59 are connected to the gate terminals G2 to G60 of the transfer thyristors S2 to S60, which are adjacent to the transfer thyristors S1 to S59, respectively. That is, the diodes D1 to D59 are connected in series, with the gate terminals G1 to G60 of the transfer thyristors S1 to S60 each interposed between adjacent ones of the diodes D1 to D59.

The anode terminal of the diode D1, i.e. the gate terminal G1 of the transfer thyristor S1, is connected to a φS terminal through the transfer-current-limiting resistor R3A. The φS terminal is supplied with the start transfer signal φS through the start-transfer-signal line 103 (see FIG. 5).

Anode terminals of the light emission thyristors L1 to L60 are connected to the GND terminal, as with the anode terminals of the transfer thyristors S1 to S60.

Cathode terminals of the light emission thyristors L1 to L60 are connected to a φI terminal. The light-emission-signal line 106 (in the light emitting chip C1, the light-emission-signal line 106_1: see FIG. 5) is connected to the φI terminal, which is supplied with the light emission signal φI (in the light emitting chip C1, the light emission signal φI1). Note that the other light emitting chips C2 to C60 are supplied with the light emission signals φI2 to φI60, respectively.

Description of Black Line and White Line Occurring at Switching Position Kp

In the present exemplary embodiment, as described above, the LPH bar 631 carrying the LEDs 71 to be lit up is switched in order of the LPH bar 631*a*, the LPH bar 631*b*, and the LPH bar 631*c*. However, if the pitch of the LEDs 71 changes at the switching position Kp, a black line or a white line may appear in the image formed on the sheet P.

Figure 7A:
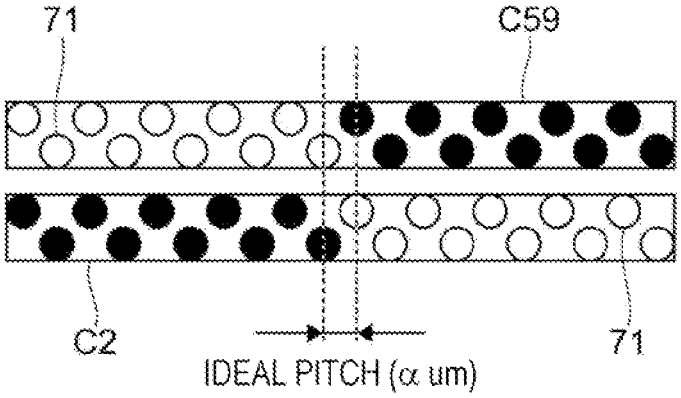
FIG. 7A illustrates a case where an image formed on a sheet has neither a black line nor a white line at a switching position.
Figure 7B:
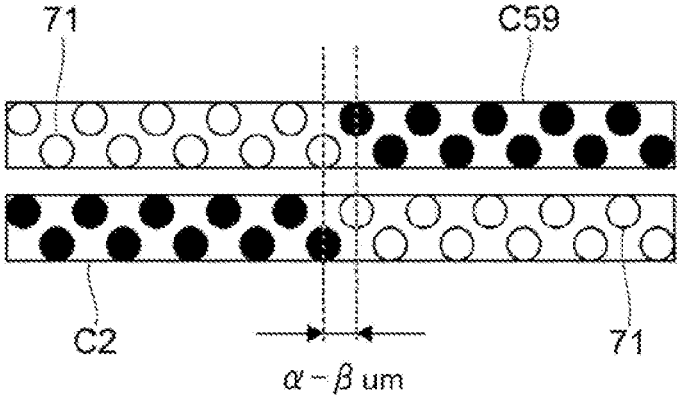
FIGS. 7B and 7C illustrate cases where an image formed on a sheet has a black line or a white line as a result of a change in the pitch of LEDs at the switching position.
Figure 7C:
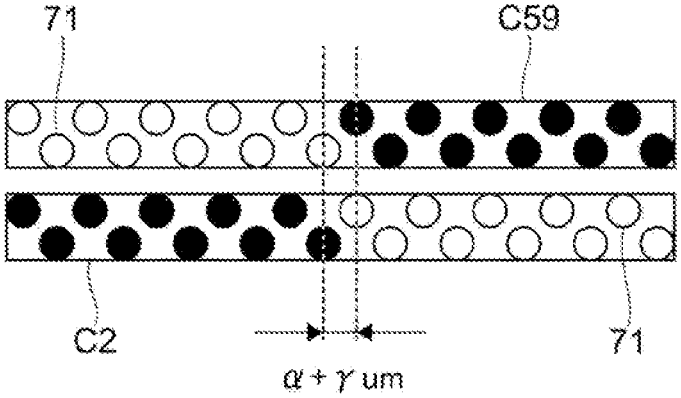

FIG. 7A illustrates a case where the image formed on the sheet P has neither a black line nor a white line at the switching position Kp. FIGS. 7B and 7C illustrate cases where the image formed on the sheet P has a black line or a white line as a result of a change in the pitch of LEDs 71 at the switching position Kp.

FIG. 7A illustrates a case where the LEDs 71 on the LPH bar 631*a* and the LEDs 71 on the LPH bar 631*b* are precisely aligned in the second scanning direction at the switching position Kp. Consequently, the pitch of the LEDs 71 at the switching position Kp is an ideal value of α μm. Specifically, the pitch of the LEDs 71 is α μm for both the LPH bar 631*a* and the LPH bar 631*b*. Furthermore, the pitch of the LEDs 71 at the switching position Kp is an ideal value of α μm for both the LPH bar 631*a* and the LPH bar 631*b*. That is, FIG. 7A illustrates a case where the ideal pitch of α μm is maintained even at the switching position Kp.

In contrast, FIGS. 7B and 7C illustrate cases where the LEDs 71 on the LPH bar 631*a* and the LEDs 71 on the LPH bar 631*b* are not precisely aligned in the second scanning direction at the switching position Kp and are therefore displaced relative to each other in the first scanning direction.

FIG. 7B illustrates a case where the pitch between the LED 71 on the LPH bar 631*a* and the LED 71 on the LPH bar 631*b* at the switching position Kp is smaller than the ideal pitch of α μm, i.e. α−β μm. In such a case, when the LEDs to be lit up are switched at the switching position Kp from those on the LPH bar 631*a* to those on the LPH bar 631*b*, the density of the resulting image is increased at the switching position Kp. Consequently, a black line extending in the second scanning direction appears in the image formed on the sheet P.

On the other hand, FIG. 7C illustrates a case where the pitch between the LED 71 on the LPH bar 631*a* and the LED 71 on the LPH bar 631*b* at the switching position Kp is greater than the ideal pitch of α μm, i.e. α+γ μm. In such a case, when the LEDs to be lit up are switched at the switching position Kp from those on the LPH bar 631*a* to those on the LPH bar 631*b*, the density of the resulting image is reduced at the switching position Kp. Consequently, a white line extending in the second scanning direction appears in the image formed on the sheet P.

The phenomena illustrated in FIGS. 7B and 7C are caused by relative displacement between the LPH bar 631*a* and the LPH bar 631*b* in the first scanning direction. That is, in the case illustrated in FIG. 7B, the LPH bar 631*a* and the LPH bar 631*b* are displaced relative to each other by −β μm in the first scanning direction. In the case illustrated in FIG. 7C, the LPH bar 631*a* and the LPH bar 631*b* are displaced relative to each other by +γ μm in the first scanning direction. However, it is difficult to determine the positions of the LPH bars 631 in the first scanning direction in the order of micrometers.

Description of Method of Suppressing Occurrence of Black Line or White Line

In the present exemplary embodiment, the occurrence of the above problem is suppressed by varying the switching position Kp as follows.

The image to be formed on a sheet P by the image forming apparatus 1 according to the present exemplary embodiment is composed of dots formed by a screening process performed with a screen having a predetermined screen angle. This method will now be described.

Figure 8A:
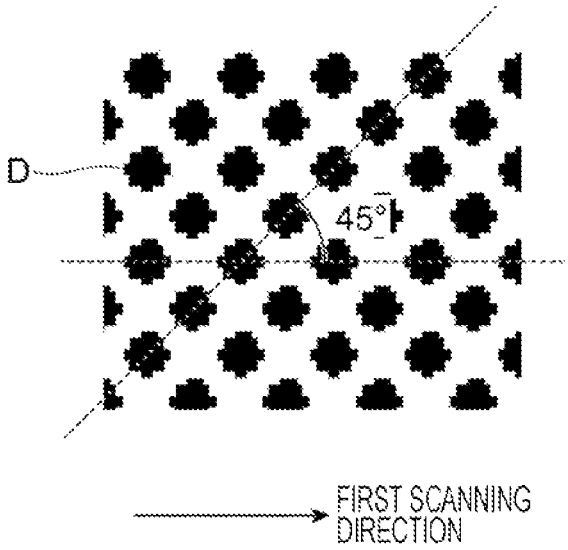
FIGS. 8A and 8B illustrate dots.
Figure 8B:
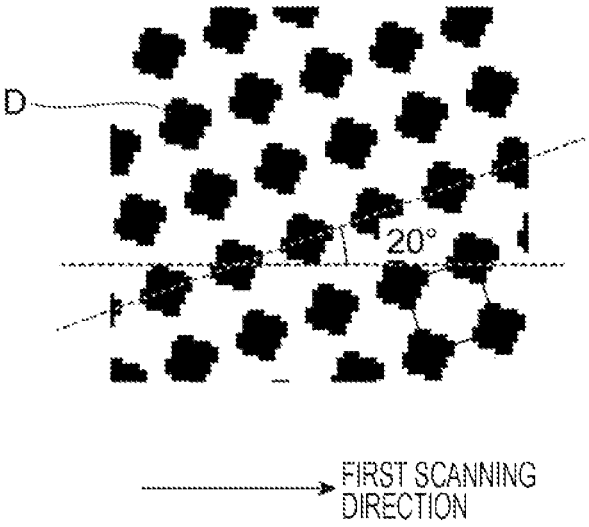

FIGS. 8A and 8B illustrate dots D.

The image to be formed by the above image forming apparatus 1 is composed of dots D illustrated in FIGS. 8A and 8B. The gradation of colors in the image is produced by adjusting the number or density of dots D. The dots D are arranged with predetermined regularity.

FIG. 8A illustrates a case where dots D are arranged in lines each forming an angle of 45 degrees with respect to the first scanning direction corresponding to the horizontal direction. The angle is referred to as screen angle. That is, FIG. 8A illustrates a case where the screen angle is 45 degrees.

FIG. 8B illustrates a case where dots D are arranged in lines each forming an angle of 20 degrees with respect to the first scanning direction corresponding to the horizontal direction. That is, FIG. 8B illustrates a case where the screen angle is 20 degrees.

The image composed of dots D is formed in an imaging process performed by the image output controller 200 in which image data is subjected to a screening process. The screen angle is determined by the screen to be used in the screening process.

The screen angle varies with the color of the toner used in the image forming apparatus 1. In the present exemplary embodiment, the screen angle for Y (yellow) is, for example, 0 degrees. The screen angle for M (magenta) is, for example, 75 degrees. The screen angle for C (cyan) is, for example, 15 degrees. The screen angle for K (black) is, for example, 45 degrees.

In the present exemplary embodiment, the switching position Kp is defined such that when points in the image that coincide with the switching position Kp are connected to one another by a line, the line forms a zigzag shape while overlapping some dots, the zigzag shape including line segments extending at the screen angle.

FIGS. 9A to 9D illustrate different switching positions Kp according to the exemplary embodiment.

Figure 9A:
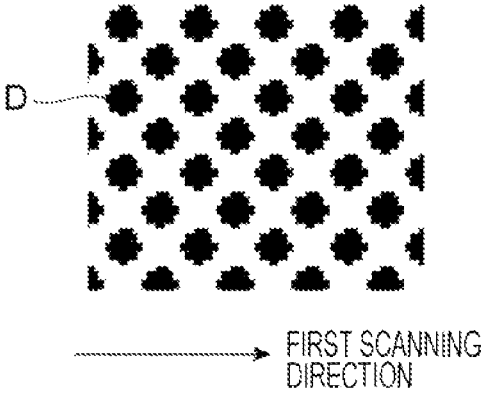
FIGS. 9A to 9D illustrate different switching positions according to the exemplary embodiment.
Figure 9B:
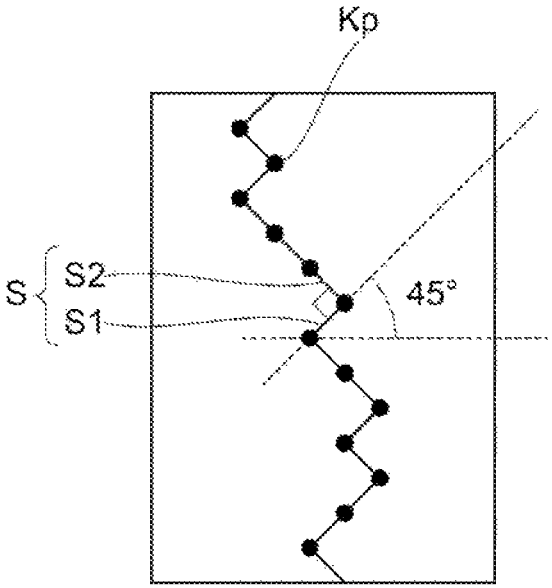

FIGS. 9A and 9B illustrate a switching position Kp in the case of a screen angle of 45 degrees.

FIG. 9A is the same diagram as FIG. 8A, illustrating dots D arranged at a screen angle of 45 degrees. FIG. 9B is a diagram illustrating a switching position Kp defined in an image formed on a sheet P by forming the dots D illustrated in FIG. 9A.

The zigzag shape illustrated in FIG. 9B is obtained when points in the image that coincide with the switching position Kp are connected to one another. That is, when the dots representing the switching position Kp in FIG. 9B are connected by a line S, the line S has a zigzag shape. The line S includes some line segments extending at a screen angle of 45 degrees with respect to the first scanning direction corresponding to the horizontal direction. Specifically, the line S includes line segments S1 extending at a screen angle of 45 degrees, and line segments S2 extending orthogonally to the line segments S1 extending at the screen angle.

Figure 9C:
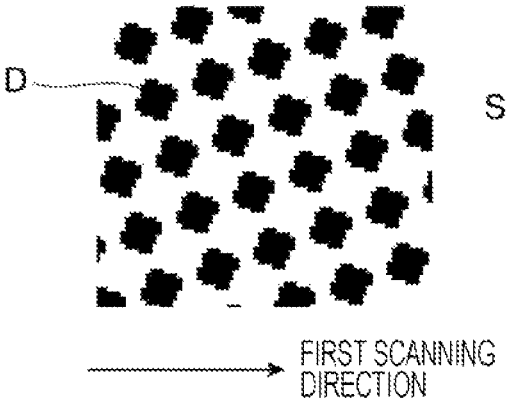
Figure 9D:
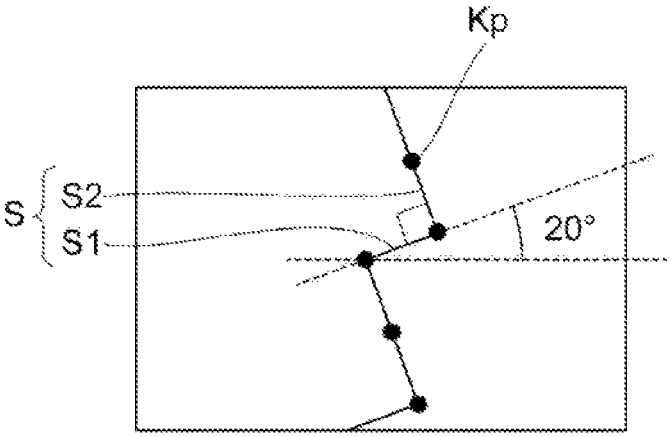

FIG. 9C is the same diagram as FIG. 8B, illustrating dots D arranged at a screen angle of 20 degrees. FIG. 9D is a diagram illustrating a switching position Kp defined in an image formed on a sheet P by forming the dots D illustrated in FIG. 9C.

In FIG. 9D as well, the position defined by dots represents the switching position Kp, and a line S connecting the dots has a zigzag shape. The line S includes some line segments extending at a screen angle of 20 degrees with respect to the first scanning direction corresponding to the horizontal direction. Specifically, the line S includes line segments S1 extending at a screen angle of 20 degrees, and line segments S2 extending orthogonally to the line segments S1 extending at the screen angle.

If the points defining the switching position Kp are at a constant position in the first scanning direction, a black line or a white line extending in the second scanning direction tends to appear in the image formed on the sheet P. In contrast, in the present exemplary embodiment, the points defining the switching position Kp are not at a constant position in the first scanning direction. Therefore, even if the density of the image is increased or reduced at the switching position Kp, the points defining the switching position Kp are not at a constant position in the first scanning direction in the image, and the switching position Kp has a zigzag shape as described above.

Figure 10A:
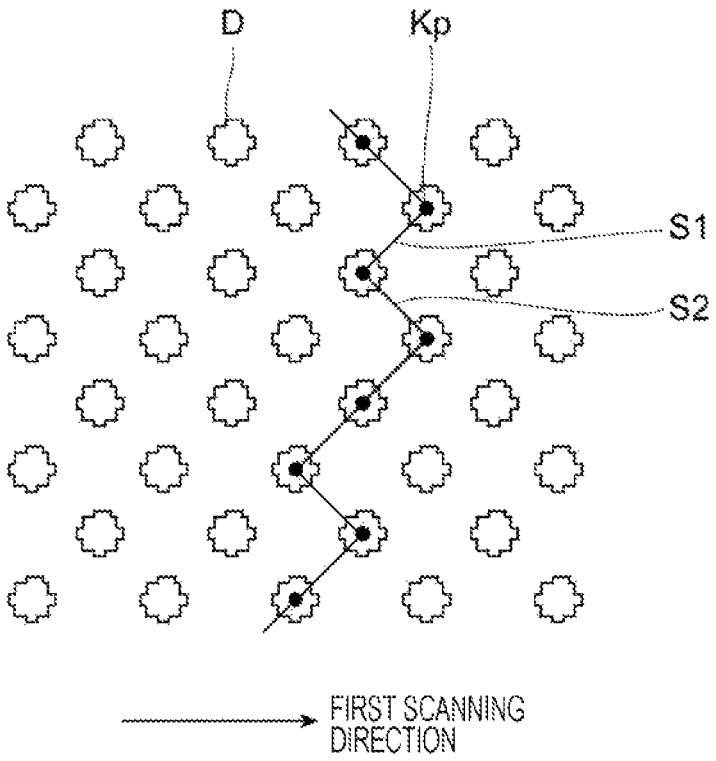
FIG. 10A illustrates a positional relationship between the switching position and dots.

FIG. 10A illustrates a positional relationship between the switching position Kp and dots D.

As illustrated in FIG. 10A, the switching position Kp overlaps some of the dots D. Furthermore, the switching position Kp may overlap positions near the centers of those dots D.

Figure 10B:
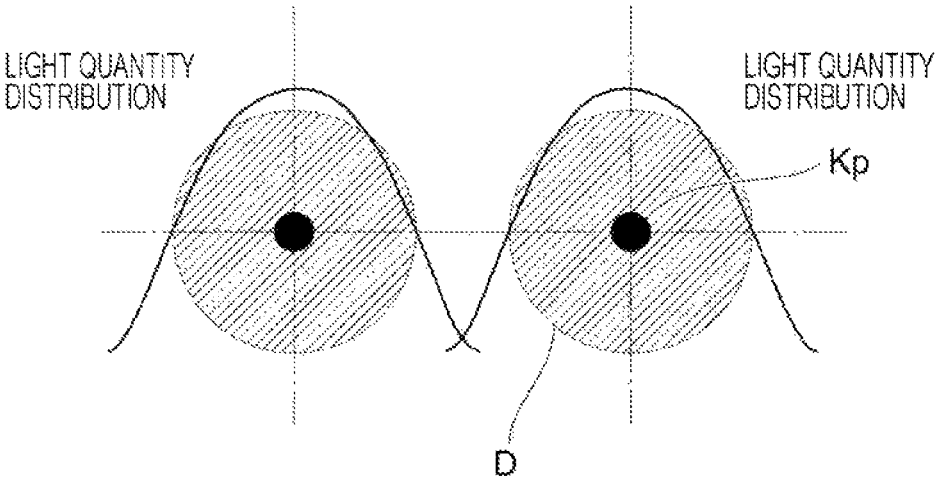
FIG. 10B illustrates the reason for employing the scheme illustrated in FIG. 10A.

FIG. 10B illustrates the reason for employing the scheme illustrated in FIG. 10A.

FIG. 10B illustrates the distribution, around dots D, of quantity of light emitted from the LEDs 71 in forming the dots D. As illustrated in FIG. 10B, the light quantity of each of the LEDs 71 is maximum at the center of the dot D. Such a case indicates that the light quantity of the LED 71 is saturated near the center of the dot D. In other words, the gradient of the distribution of light quantity is substantially flat near the center of the dot D. In contrast, the distribution of light quantity changes greatly at any position except positions near the center of the dot D. In other words, the gradient of the distribution of light quantity is steep at any position except positions near the center of the dot D.

If the switching position Kp overlaps a position near the center of the dot D, where the light quantity of the LED 71 is saturated, there is substantially no difference in the light quantity of the LED 71 from that at the center of the dot D even if the switching position Kp is displaced a little from the center of the dot D. Therefore, if the switching position Kp overlaps a position near the center of the dot D, the density at the switching position Kp is less likely to change.

In contrast, the distribution of light quantity changes greatly at any position except positions near the center of the dot D. Therefore, if the switching position Kp is displaced a little, the difference in the light quantity of the LED 71 from that at the center of the dot D increases. Therefore, if the switching position Kp overlaps a position other than a position near the center of the dot D, the density at the switching position Kp tends to vary. Consequently, the influence of displacement of the LPH bars 631 in the first scanning direction is great.

As illustrated in FIGS. 9B and 9D, the zigzag shape may be defined with no regularity. That is, the zigzag shape may be a random shape so that the switching position Kp varies randomly. The zigzag shape is not limited to the above and may have regularity.

Figure 11A:
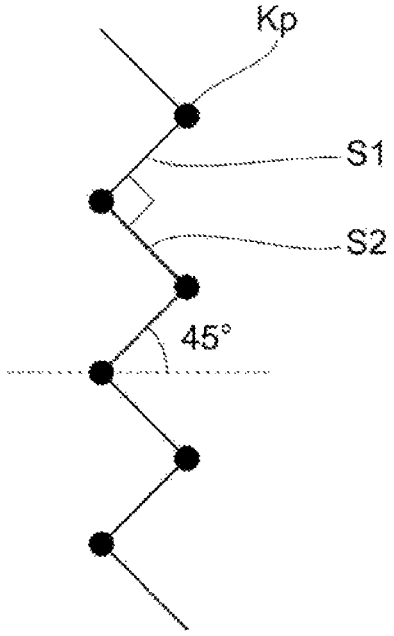
FIGS. 11A and 11B illustrate exemplary zigzag shapes each having regularity.
Figure 11B:
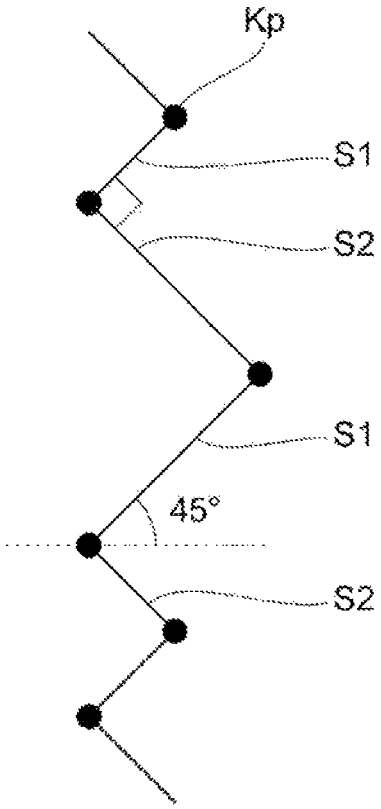

FIGS. 11A and 11B illustrate exemplary zigzag shapes each having regularity.

FIG. 11A illustrates a case where line segments S1 and line segments S2 having the same length are arranged alternately. FIG. 11B illustrates a case where line segments S1 and line segments S2 having two different lengths are arranged. Note that FIGS. 11A and 11B both illustrate a case where the screen angle is 45 degrees.

The zigzag shape is defined within an area having a predetermined width in the first scanning direction. Specifically, since the displacement of the LEDs 71 illustrated in FIGS. 7B and 7C occurs in the double portion 633 between different LPH bars 631, the zigzag shape is defined within an area defined by the width of the double portion 633.

As described above, the screen angle is made to vary with the color of the toner used in the image forming apparatus 1. Therefore, the zigzag shape is defined in accordance with the screen angle determined by the color of the toner.

To practically define the zigzag shape, a mask having the zigzag shape may be prepared to be used for defining the switching position Kp. That is, the switching position Kp is defined by using a mask corresponding to the screen angle determined by the color of the toner.

Description of Functional Configuration of Signal Generating Circuit 100

A functional configuration of the signal generating circuit 100 will now be described.

Figure 12:
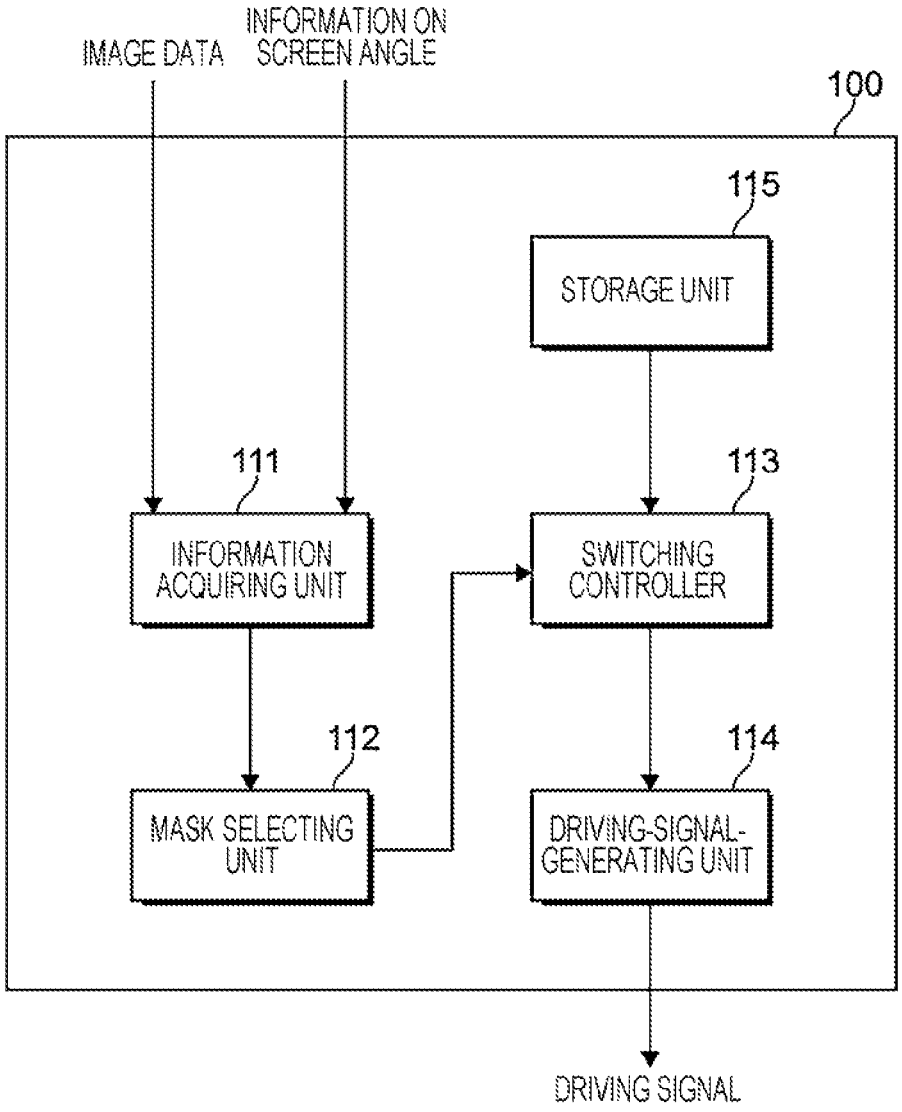
FIG. 12 is a block diagram illustrating an exemplary functional configuration of the signal generating circuit according to the exemplary embodiment.

FIG. 12 is a block diagram illustrating an exemplary functional configuration of the signal generating circuit 100 according to the exemplary embodiment. Note that FIG. 12 illustrates only some of various functions of the signal generating circuit 100 that are relevant to the present exemplary embodiment.

As illustrated in FIG. 12, the signal generating circuit 100 includes an information acquiring unit 111 that acquires information such as image data, a mask selecting unit 112 that selects a mask, a switching controller 113 that controls the operation of switching the LEDs 71 to be lit up among those on different LPH bars 631, a driving-signal-generating unit 114 that generates driving signals, and a storage unit 115 that stores information on the mask.

The information acquiring unit 111 receives image data from the image output controller 200. As described above, the image data is inputted from the external apparatus such as a PC and is subjected to an imaging process and the like performed by the image output controller 200, so that the image data is usable in forming an image by the image forming units 11. Specific examples of the imaging process include rasterization, color conversion, pile-height measurement, screening, and the like.

The information acquiring unit 111 acquires information on the screen angle to be referred to in the image forming apparatus 1. The screen angle is acquired for each of the colors of the toner used in the image forming apparatus 1.

The mask selecting unit 112 determines a mask to be used for defining the switching position Kp, on the basis of the information on the screen angle acquired by the information acquiring unit 111.

The switching controller 113 controls the operation of switching the LPH bar 631 to be lit up at the switching position Kp. The switching controller 113 acquires the information on the mask selected by the mask selecting unit 112 from the storage unit 115. Thus, the switching controller 113 defines the switching position Kp by using the selected mask.

The driving-signal-generating unit 114 generates driving waveforms for lighting up the LEDs 71 and outputs the driving waveforms as driving signals. Specifically, for example, the driving-signal-generating unit 114 generates driving waveforms of the light emission signal φI, the start transfer signal φS, the first transfer signal φ1, and the second transfer signal φ2 described above and outputs these signals as driving signals.

Description of Operation of Image Forming Apparatus 1

An operation performed by the image forming apparatus 1 will now be described.

Figure 13:
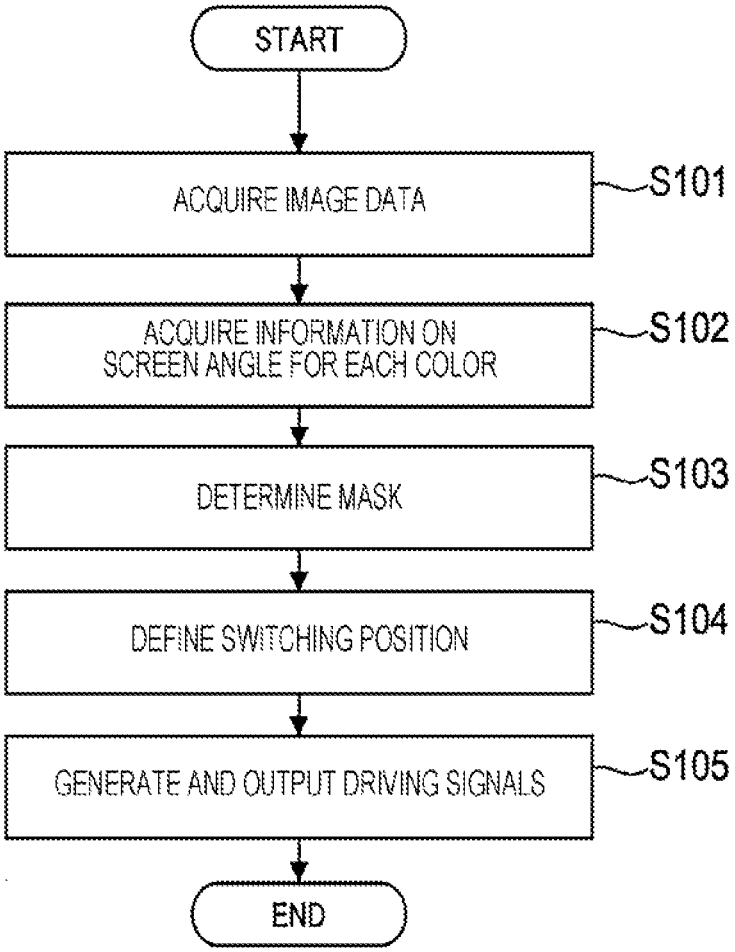
FIG. 13 is a flow chart illustrating an operation of the image forming apparatus according to the exemplary embodiment.

FIG. 13 is a flow chart illustrating an operation of the image forming apparatus 1 according to the exemplary embodiment.

First, the information acquiring unit 111 acquires image data to be printed (step 101).

Furthermore, the information acquiring unit 111 acquires information on the screen angle to be referred to in the image forming apparatus 1 for each of the colors (step 102).

Subsequently, the mask selecting unit 112 determines a mask for defining the switching position Kp, in accordance with the screen angle (step 103).

Then, the switching controller 113 acquires the information on the mask selected by the mask selecting unit 112 from the storage unit 115 and defines the switching position Kp with reference to the mask (step 104).

Subsequently, the driving-signal-generating unit 114 generates driving signals in accordance with the switching position Kp defined by the switching controller 113 and outputs the driving signals (step 105). Then, printing is performed.

According to the above exemplary embodiment, the light-emitting-device head 14 and the image forming apparatus 1 in which the image formed on the sheet P is less likely to have a black line or a white line at each switching position Kp are provided.

While the above exemplary embodiment concerns the correction of density variation in each double portion 633 between different LPH bars 631, the present disclosure is also applicable to the suppression of the appearance of a black line or a white line at the boundary between different light emitting chips C due to the displacement of the light emitting chips C in the first scanning direction.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A light-emitting-device head comprising:

a first light-emitting-device arrangement including light emitting devices arranged in lines extending in a first scanning direction;

a second light-emitting-device arrangement including light emitting devices arranged in lines extending in the first scanning direction, the second light-emitting-device arrangement overlapping the first light-emitting-device arrangement in a second scanning direction at least in part;

an optical device that forms an electrostatic latent image by focusing light emitted from the light emitting devices on a photoconductor and exposing the photoconductor to the light; and a switching unit that switches the light-emitting-device arrangement to be lit up between the first light-emitting-device arrangement and the second light-emitting-device arrangement at a switching position defined at any position in an overlapping portion where the first light-emitting-device arrangement and the second light-emitting-device arrangement overlap each other, wherein the electrostatic latent image is composed of dots formed by a screening process performed with a screen having a predetermined screen angle, and wherein the switching unit defines the switching position such that when points in the electrostatic latent image that coincide with the switching position are connected to one another by a line, the line forms a zigzag shape that overlaps some of the dots, the line comprising a plurality of line segments each extending at the screen angle.

2. The light-emitting-device head according to claim 1, wherein the switching unit defines the zigzag shape within an area having a predetermined width in the first scanning direction.

3. The light-emitting-device head according to claim 2, wherein the switching unit defines the zigzag shape with no regularity.

4. The light-emitting-device head according to claim 1, wherein the switching unit defines the zigzag shape in accordance with the screen angle determined by a color of toner.

5. The light-emitting-device head according to claim 4, wherein the switching unit defines the switching position by using a mask corresponding to the screen angle determined by the color of the toner.

6. The light-emitting-device head according to claim 1, wherein the line further comprises a line segment extending orthogonally to at least one of the plurality of line segments extending at the screen angle.

7. The light-emitting-device head according to claim 1, wherein the first light-emitting-device arrangement and the second light-emitting-device arrangement are each a structure obtained by arranging light-emitting-device-array chips each including the light emitting devices arranged in lines extending in the first scanning direction.

8. An image forming apparatus comprising:

a toner-image-forming unit that forms a toner image by using a first light-emitting-device arrangement and a second light-emitting-device arrangement in each of which light-emitting devices are arranged in lines extending in a first scanning direction, the second light-emitting-device arrangement overlapping the first light-emitting-device arrangement in a second scanning direction at least in part, and an optical device that forms an electrostatic latent image by focusing light emitted from the light-emitting devices and exposing a photoconductor to the light;

a transfer unit that transfers the toner image to a recording medium;

a fixing unit that fixes the toner image transferred to the recording medium and finishes the image on the recording medium; and a switching unit that switches the light-emitting-device arrangement to be lit up between the first light-emitting-device arrangement and the second light-emitting-device arrangement at a switching position defined at any position in an overlapping portion where the first light-emitting-device arrangement and the second light-emitting-device arrangement overlap each other, wherein the image formed on the recording medium is composed of dots formed by a screening process performed with a screen having a predetermined screen angle, and wherein the switching unit defines the switching position such that when points in the image on the recording medium that coincide with the switching position are connected to one another by a line, the line forms a zigzag shape that overlaps some of the dots, the line comprising a plurality of line segments each extending at the screen angle.

9. A light-emitting-device head comprising:

a first light-emitting-device arrangement including light emitting devices arranged in lines extending in a first scanning direction;

a second light-emitting-device arrangement including light emitting devices arranged in lines extending in the first scanning direction, the second light-emitting-device arrangement overlapping the first light-emitting-device arrangement in a second scanning direction at least in part;

an optical device that forms an electrostatic latent image by focusing light emitted from the light emitting devices on a photoconductor and exposing the photoconductor to the light; and means for switching the light-emitting-device arrangement to be lit up between the first light-emitting-device arrangement and the second light-emitting-device arrangement at a switching position defined at any position in an overlapping portion where the first light-emitting-device arrangement and the second light-emitting-device arrangement overlap each other, wherein the electrostatic latent image is composed of dots formed by a screening process performed with a screen having a predetermined screen angle, and wherein the switching means defines the switching position such that when points in the electrostatic latent image that coincide with the switching position are connected to one another by a line, the line forms a zigzag shape that overlaps some of the dots, the line comprising a plurality of line segments each extending at the screen angle.

* * * * *